US006227958B1

(12) United States Patent
Neuberg

(10) Patent No.: US 6,227,958 B1
(45) Date of Patent: May 8, 2001

(54) KNIFE AND SHARPENING HOLDER

(76) Inventor: William Neuberg, 30 Bittner Rd., Perrineville, NJ (US) 08535

( * ) Notice: Subject to any disclaimer, the term of this patent is extended or adjusted under 35 U.S.C. 154(b) by 0 days.

(21) Appl. No.: 09/287,224

(22) Filed: Apr. 6, 1999

Related U.S. Application Data

(60) Provisional application No. 60/106,984, filed on Nov. 4, 1998.

(51) Int. Cl.[7] ..... B24B 19/00

(52) U.S. Cl. ..... 451/367; 451/368; 451/369; 451/370; 451/371; 451/391; 30/298.4; 30/76; 30/82; 30/269; 30/3

(58) Field of Search ..... 451/367–371, 451/386, 378, 391; 30/298.4, 329, 339; 26/82, 1, 2; 289/3, 47, 556, 96

(56) References Cited

U.S. PATENT DOCUMENTS

| | | | | |
|---|---|---|---|---|
| D. 363,302 | | 10/1995 | Ross . | |
| 1,449,355 | * | 3/1923 | Tagliaferry | 451/378 |
| 1,936,016 | * | 11/1933 | Hay | 451/376 |
| 3,289,358 | * | 12/1966 | Longobardi | 451/367 |
| 3,654,823 | | 4/1972 | Juranitch . | |
| 3,800,632 | | 4/1974 | Juranitch . | |
| 3,913,903 | | 10/1975 | Seward et al. . | |
| 3,924,360 | | 12/1975 | Haile et al. . | |
| 4,180,909 | * | 1/1980 | Lind | 30/332 |
| 4,266,448 | | 5/1981 | Alderman . | |
| 4,497,142 | | 2/1985 | Sessoms . | |
| 4,866,845 | | 9/1989 | McEvily . | |
| 4,991,357 | | 2/1991 | Stickles, Sr. . | |
| 5,094,038 | | 3/1992 | Maruyama . | |
| 5,138,801 | | 8/1992 | Anthon et al. . | |
| 5,157,879 | | 10/1992 | Fletcher . | |
| 5,461,785 | | 10/1995 | Sol Na . | |
| 5,472,375 | | 12/1995 | Pugh . | |

* cited by examiner

*Primary Examiner*—Joseph J. Hail, III
*Assistant Examiner*—George Nguyen
(74) *Attorney, Agent, or Firm*—Baker Botts L.L.P.

(57) ABSTRACT

A sharpening holder and a knife are uniquely configured for use with each other, the holder and the knife having permanent elements that mate when the holder is installed on the knife so that the holder is installed on the knife in exactly the same position on the knife every time that the knife is sharpened.

6 Claims, 3 Drawing Sheets

KNIFE AND SHARPENING HOLDER

The present application is based on U.S. Provisional Patent Appln. Ser. No. 60/106,984, filed Nov. 4, 1998.

BACKGROUND OF THE INVENTION

The present invention relates to a knife and a sharpening holder by which the blade of the knife is guided at a predetermined angle with respect to the surface of a sharpening hone when it is being sharpened.

U.S. Pat. Nos. 3,654,823 and 3,800,632 to Juranitch describe and show two-part blade holders that are clamped to the blade of a knife and have a guide bar or flange on each part that bears against the surface of a sharpening hone when the knife is sharpened and maintains the blade at the same angle to the surface of the hone as sharpening progresses. The Juranitch patents are hereby incorporated by reference into the present document for all purposes.

The holders of the Juranitch patents, and holders based on the designs disclosed in the Juranitch patent that are commercially available, are intended to be used interchangeably on different knives. To attach them, the user installs the holder on the blade by positioning the holder on the blade at a specified distance between the cutting edge of the blade and the tip of the clamping portion of the holder with the aid of a ruler or other measuring implement. While the ability to use a Juranitch holder on different knives has the advantage of allowing a user to sharpen several knives with the aid of the same holder, there is a disadvantage to a universal, adjustable holder that is designed to be used with different knives. The disadvantage has two aspects.

One aspect is that it is virtually impossible to install a Juranitch holder on a given knife that is about to be sharpened in the same position on the knife in which it was installed the last time that it was sharpened—the distance between the guide edges of the flange and the cutting edge of the knife blade may be different—the position of the holder lengthwise of the blade may also be different—the holder may be at slightly different angle (cocked) relative to the blade. Even if the difference in the position of the holder from the last sharpening of a particular knife is small, sharpening nonetheless requires grinding a new edge with a different angle to the surface of the blade and removing a relatively large amount of blade material. Consequently, sharpening takes a relatively long time, and each sharpening reduces the life of the blade.

Another aspect of the disadvantage of a universal holder is that if the holder is used to sharpen several knives between the time that a given knife was previously sharpened and the time of resharpening of that knife, the configuration of the holder may have changed due to grinding away of some of the guide edges of the holder parts. Some users push the holder hard against the sharpening hone, thus removing material from the guide edges of the holder parts at about the same rate as from the cutting edge of the knife being sharpened. Therefore, even assuming that the holder is installed on a given knife in a position precisely the same as the position during the last sharpening of the particular knife, any change in the holder has the same effect as a change in the position of the knife in the holder—requiring a lot of honing to establish a slightly different angle of the cutting edge from that produced in the previous sharpening.

SUMMARY OF THE INVENTION

An object of the present invention is to ensure that a given knife, each time that it is sharpened, is positioned precisely in the same position in the holder, thereby considerably reducing the amount of blade material that has to be ground away from the cutting edge to sharpen it and the time required for each sharpening. Another object is to ensure that the geometry of the holder is the same at the time of a sharpening of a knife as it was after the last sharpening of the knife was completed.

In accordance with one aspect of the present invention, a sharpening holder and a knife are uniquely configured for use with each other—the holder is dedicated to a single knife. It is contemplated, in particular, that a knife will be sold with a holder and the holder will be used only with the knife with which it is sold. Suitable indicia on the knife and the holder can be provided so that the owner can readily match them. Moreover, the holder will more than likely not be capable of being used with any other knives owned by the user, unless the user has two or more identical knives.

The other aspect of the invention is that the knife and the holder have permanent elements that mate when the holder is installed on the knife blade so that the holder is installed on the knife in exactly the same position on the knife every time that the knife is sharpened.

The two aspects of the invention described above eliminate both aspects of the problem of a universal holder. Because the holder is used for only one knife, its geometry at the time of each use is the same as it was at the completion of the last sharpening of the knife with which it is mated for life—the guide edge of each holder part has not been ground away by use with other knives—the holder has been stored away. When the holder is installed to sharpen its mate, the knife, the permanent mating elements ensure that the holder is in the same position on the knife blade as it was the last time the knife was sharpened. Maintaining the geometry of the holder the same at the end of one sharpening and the beginning of the next sharpening of the mated holder/knife and the ability to position the holder on the blade in exactly the same position for every sharpening means that the cutting edge of the knife need not be reestablished by a lot of grinding. Both the knife and the holder last much longer and the time for each sharpening is greatly reduced, as compared to sharpening using a universal holder.

DESCRIPTION OF THE DRAWINGS

For a more complete understanding of the present invention, and the advantages thereof, reference may be made to the following written description of exemplary embodiments, taken in conjunction with the accompanying drawings.

DESCRIPTION OF THE EMBODIMENTS

Figure 2:
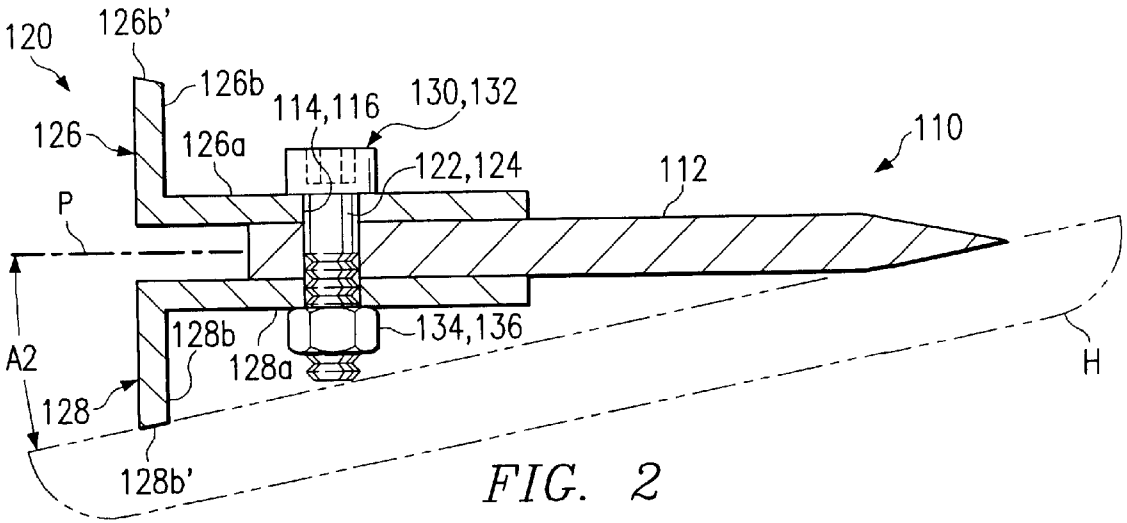
FIG. 2 is an end cross-sectional view of the knife and holder of FIG. 1, taken along the lines 2—2 of FIG. 1.

In the drawings the last two digits of the reference numerals used for elements of the embodiments that correspond are the same. The first digits correspond to the embodiment—viz., the digit 1 refers to the first embodiment, 2 to the second, and so forth.

In the first embodiment the blade 112 of a knife 110 (part of the handle is cut away) is provided with permanent locating elements 114 and 116 that mate with permanent locating elements 122 and 124 of a holder 120 so that the holder 120 is installed on the blade 112 in exactly the same position every time that the knife is sharpened. The holder 120 consists of two parts 126 and 128 in the form of metal angles, each having a longer leg portion 126*a,* 128*a* that is clamped to the blade 112 and a guide flange portion 126*b,* 128*b,* the edge 126*b*' and 128*b*' of which is a guide surface that bears against the surface of a hone when the holder is installed on the blade and the blade is being sharpened. Reference may be made to the Juranitch patents for a description and drawings that disclose how a knife is sharpened with a holder in place.

The holder is attached in clamped relation to the blade by two screws 130 and 132 and nuts 134 and 136 received and tightened on the screws. The mating elements of the first embodiment consist of holes 114, 116 in the blade 112 of the knife 110 and the shanks 122, 124 of the screws 130, 132.

It is known from Juranitch that a razor sharp edge can be formed on a blade by first coarse-grinding the blade with a holder in a position that establishes a smaller angle between the faces of the blade and the surface of the hone and repositioning the holder on the blade to establish a slightly larger angle and performing a final fine-honing at the larger angle. In the first embodiment the holder 120 is repositioned to establish the larger fine-honing angle of the blade to the surface of the hone by loosening the nuts 134, 136 and installing a shim 140 (FIG. 3) between each face of the blade and the longer leg portion 126*a,* 128*b* of each holder part 126, 128, as shown in FIG. 4. Shimming, of course, relocates the guide edges 126*b*' and 128*b*' farther from the center plane of the blade 112, thus increasing the angle A of the blade to the surface of a hone H, that angle being the angle whose sine is equal to the perpendicular distance Y between the center plane P of the blade and the guide edge 126*b*' or 128*b*' and the distance X along the center plane between the tip of the cutting edge of the blade and the flange 126 or 128 of the holder part. By increasing Y with the shims 140 but leaving X the same, the angle A (FIG. 2) is increased to angle A2 (FIG.4).

Figure 6:
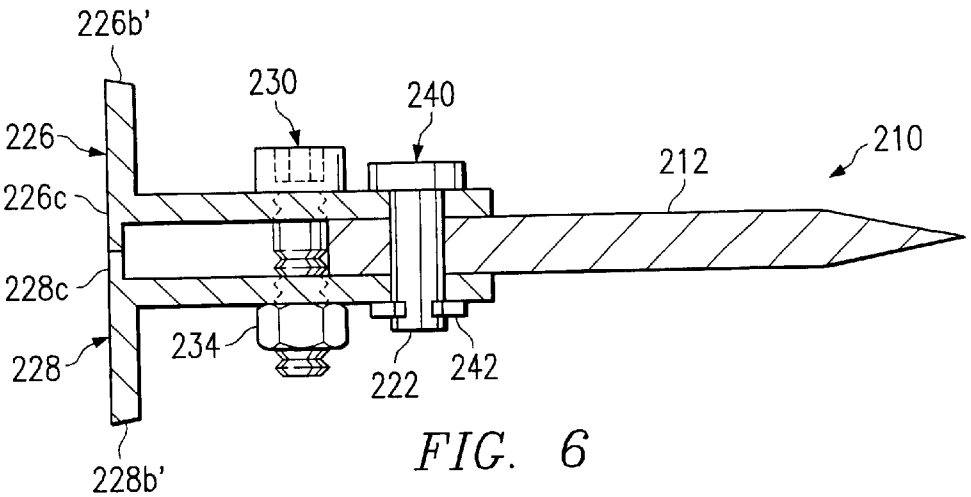
FIG. 6 is an end cross-sectional view of the knife and holder of FIG. 5, taken along the lines 6—6 of FIG. 5.
Figure 5:
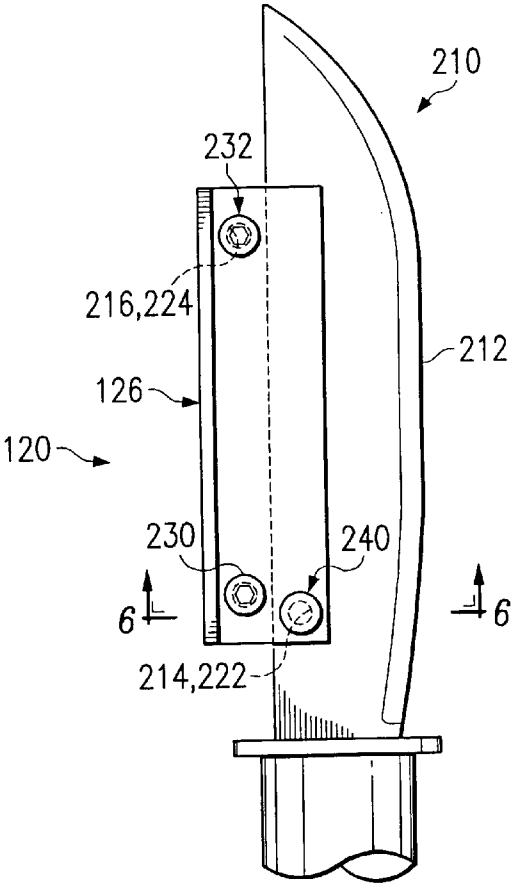
FIG. 5 is a side view of a second embodiment.

In the second embodiment, as shown in FIGS. 5 and 6, the knife blade 212 has a single hole 214 that serves as one of the permanent locating elements. Some folding knives have a hole for a finger tip that facilitates opening the blade, which can serve as the locating element. The hole 214 can also be made especially for use with the holder 220. The locating element of the holder that mates with the hole 214 is the shank 222 of a pin 240 that is inserted into the hole 214 and is held in place by a C-ring 242. The other locating element of the blade 212 is a point 216 on the heel edge of the blade, which engaged by the shank 224 of a screw 232, the shank 224 being the other locating element of the holder 220.

The holder parts 226 and 228 include dependent ribs 226*c* and 228*c,* which engage each other and serve as a fulcrum so as to enable a clamping force to be applied to the holder parts against the blade by the screw 232 onto which a nut 236 is tightened and a second screw 230 and a nut 234. The first locating elements 214, 222 establish the position of the holder along the length of the blade and the distance of the proximal end of the holder from the cutting edge. The second locating elements 224 establish the spacing of the distal end of the holder from the cutting edge.

Figure 3:
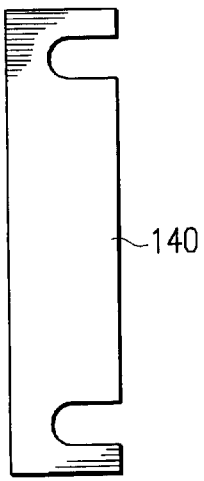
FIG. 3 is a plan view of a shim that is used to reposition the guide edges of the holder parts for fine-honing of the cutting edge.
Figure 4:
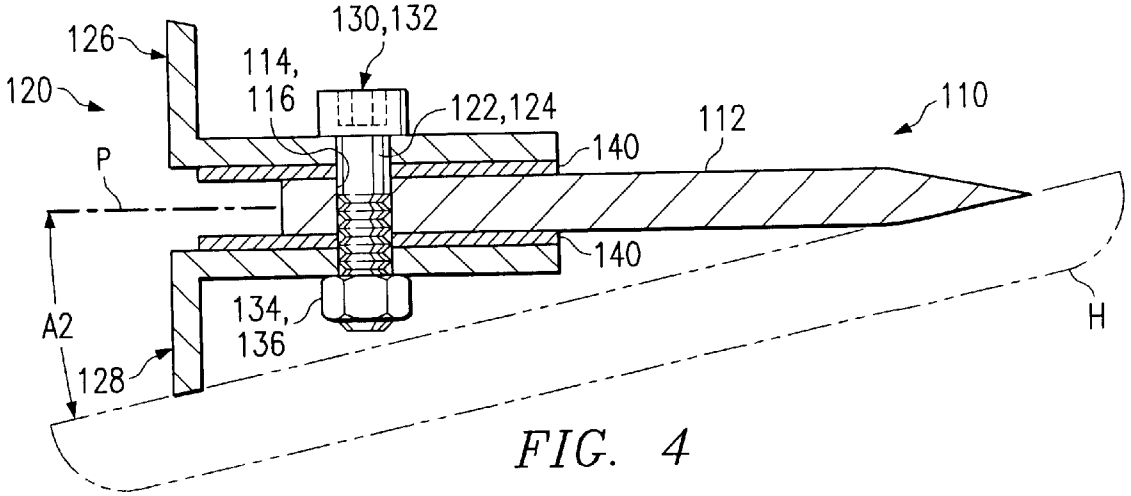
FIG. 4 is an end cross-sectional view of the holder installed on the knife with the shims in place.

The final fine honing of the knife 200 can be done by inserting shims like that shown in FIG. 3. The pin 242 can be made long enough to permit the shims to be inserted. If necessary, two grooves for the D-ring can be provided.

The embodiment of FIGS. 5 and 6 can be modified to provide for acceptance by the holder of a pin on the blade as one locating element. Some folding knives have pins that aid in opening the blade. The mating locating element on the holder is a hole in one of the holder parts. The screw 230 can play in role in locating the proximal end of the holder relative to the cutting edge of the blade.

Figure 7:
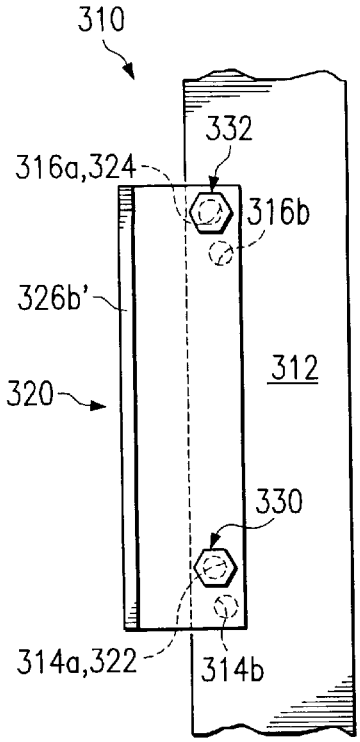
FIG. 7 is a side view of a third embodiment, in which the holder is shown in a position for course grinding.
Figure 8:
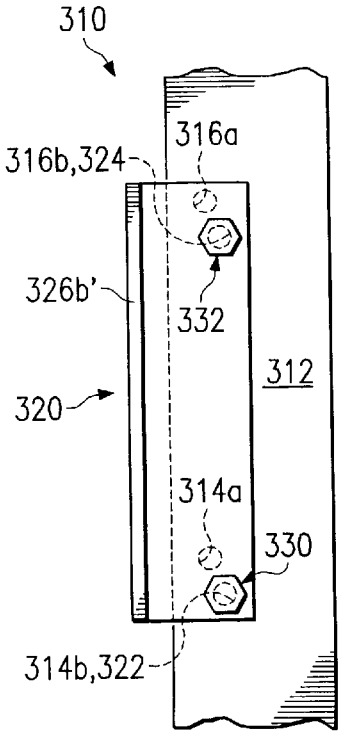
FIG. 8 is a side view of a third embodiment, in which the holder is shown in a position for fine honing.

The third embodiment (FIG. 7 and 8) is a modification of the embodiment of FIGS. 1 to 4. The blade 312 has a first pair of locating elements 214*a* and 216*a* in the form of holes. The holes receive the shanks 322 and 324 of screws 330 and 332 by which, with the aid of nuts (not shown) the holder parts are clamped to the blade. In the position of the holder 320 shown in FIG. 7, the blade is given a coarse grinding. For fine honing, the holder 320 is removed and repositioned with the screws 330, 332 inserted through a second set of holes 314*b* and 316*b* in the knife blade 312, which are closer to the cutting edge (see FIG. 8). By reducing the distance X between the cutting edge of the blade and the guide edges 326*b*' and 328*b*' (see FIG. 2), as measured at the center plane of the blade, the sine of the angle between the center plane of the blade and the hone is increased—hence the honing angle is greater than in the coarse grinding angle provided by the set-up of FIG. 7.

Figure 9:
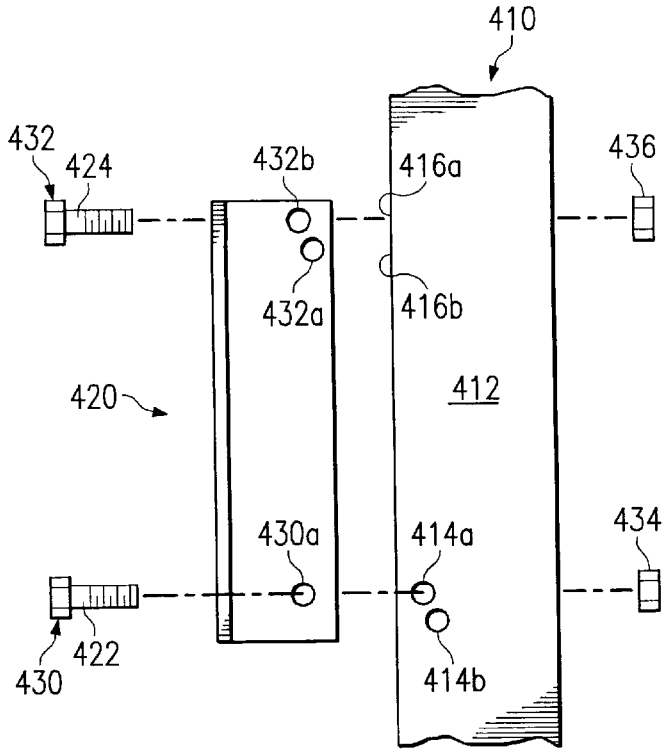
FIG. 9 is an exploded plan view of a fourth embodiment.

The knife 400 of FIG. 9 has two holes 414*a* and 414*b,* either of which receives a screw 430 by which the distal end of the holder 420 is clamped to the blade 412 with the aid of a nut 434. The two holder parts have aligned holes 430*a* for the screw 430. The two holder parts have two aligned holes 432*a* and 432*b,* each of which can receive a screw 432 by which the distal end of the holder 420 is clamped to the blade 412 with the aid of a nut 436. For coarse grinding, the holder is attached by inserting the screw through the holes 430*a* in the holder parts and the hole 414*a* in the blade and inserting the screw 432 in the aligned holes 432*a* in the holder parts and engaging the screw with the heel edge of the blade, engagement at the point 416*a* of the screw shank 424 providing a distal locating point for the holder. For fine honing the holder 420 is repositioned on the blade with the screw 430 inserted through the locating hole 414*b* and the screw 432 inserted through the holes 432*b* in the holder. The point 416*b* on the blade heel by the screw shank 424 provides a location element of the blade 412 for the distal end of the holder 430.

Figure 1:
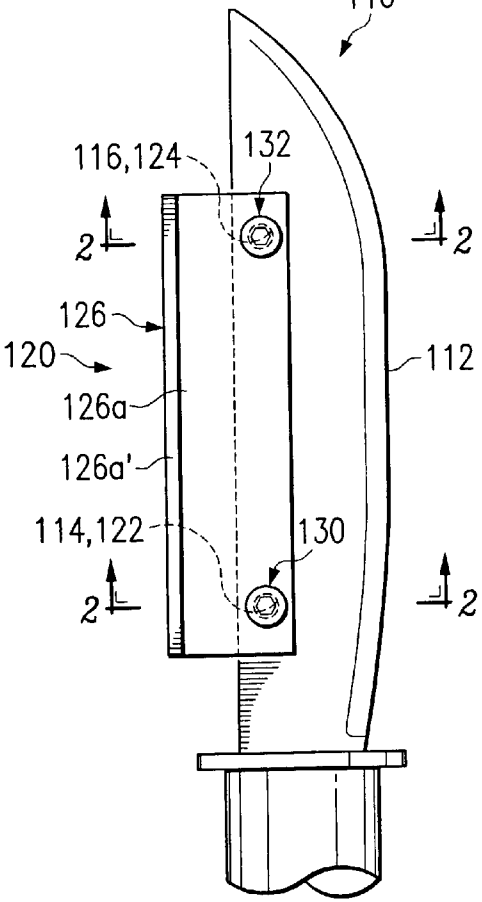
FIG. 1 is side view of a knife with a holder installed for use, according to a first embodiment of the invention.
Figure 10:
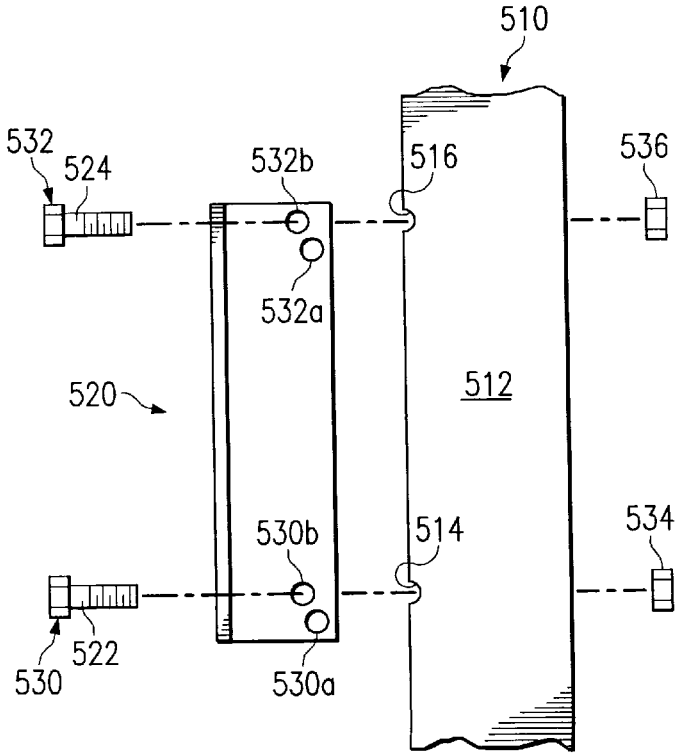
FIG. 10 is an exploded plan view of a fifth embodiment.

The fifth embodiment of FIG. 10 is another variant of the embodiment of FIG. 1. Notches 514 and 516 in the heel edge of the blade 512 (which could also be holes) provide permanent location points on the blade 512. The holder parts have aligned holes 530*a* near the proximal end that receive a screw 530 to establish the spacing of the holder from the cutting edge for coarse grinding by engagement of the shank 532 in the notch 514 and also to clamp the holder to the blade with the aid of a nut 534. The coarse grinding position of the distal end of the holder is established by engagement of the shank 524 of the screw 532 in the notch 516, the screw being received in the holes 532*a* and receiving a nut 536.

For fine honing, the holder 520 is repositioned on the blade 512 with the screw 530 received in the holes 530*b* and its shank 532 engaged in the notch 514 and the screw 532 received in the holes 530*b* and its shank engaged in the notch 516.

The foregoing embodiments show various forms of permanent location points, the use of shims or two sets of location points, which can be on the blade or the holder, or partly on each, and other variants of the invention. The holder can be fabricated in various ways from various materials. Extruded or molded plastic holder bodies can receive metal strips as inserts that provide the guide edges that engage the hones. Holder parts cut from extrusions of aluminum or bronze with hard steel strips that serve as guide edges is another good way of making the holders. One of the holder parts can have threaded holes that replace separate nuts. These and other variations and modifications of the embodiments can be devised by those of ordinary skill in the art without departing from the spirit and scope of the invention.

What is claimed is:

1. A sharpening holder and a knife having a handle and a blade, the holder and the knife being uniquely configured for use with each other, the holder and the knife blade having permanent locating elements that mate when the holder is installed on the knife blade so that the holder is installed on the knife blade in exactly the same position on the knife blade every time that the knife is sharpened, the locating elements including a hole or notch in the knife blade and a detachable fastener received in a hole in the holder and the hole or notch in the knife blade so as to establish at least in part the position of the holder on the knife blade and secure the holder to the knife blade and a pin on the blade of the knife and a hole in the holder receiving the pin.

2. A sharpening holder and a knife having a handle and a blade, the holder and the knife being uniquely configured for use with each other, the holder and the knife blade having permanent locating elements that mate when the holder is installed on the knife blade so that the holder is installed on the knife blade in exactly the same position on the knife blade every time that the knife is sharpened, the locating elements including a hole or notch in the knife blade and a detachable fastener received in a hole in the holder and the hole or notch in the knife blade so as to establish at least in part the position of the holder on the knife blade and secure the holder to the knife blade, and wherein there are locating elements that establish a smaller angle between the faces of the blade and the surface of a hone for coarse sharpening and locating elements that establish a larger angle between the faces of the blade and the surface of a hone for a final fine-honing at the larger angle.

3. A sharpening holder and a knife according to claim 2, wherein the locating elements for establishing the larger angle include a shim.

4. A sharpening holder and a knife having a handle and a blade, the holder and the knife being uniquely configured for use with each other, the holder and the knife blade having permanent locating elements that mate when the holder is installed on the knife blade so that the holder is installed on the knife blade in exactly the same position on the knife blade every time that the knife is sharpened, the locating elements including a hole or notch in the knife blade and a detachable fastener received in a hole in the holder and the hole or notch in the knife blade so as to establish at least in part the position of the holder on the knife blade and secure the holder to the knife blade, the holder including a holder member having a portion engaging the blade and a portion having a guide surface adapted to engage the surface of a sharpening hone, and the holder and the knife having locating elements arranged to enable the holder member to be positioned in a first position relative to the blade to establish a smaller angle between the faces of the blade and the surface of the hone for coarse sharpening and in a second position relative to the blade to establish a larger angle between the faces of the blade and the surface of a hone for a final fine-honing at the larger angle.

5. A sharpening holder and a knife according to claim 4, wherein the locating elements include spaced-apart holes in the blade at different distances from the cutting edge.

6. A sharpening holder and a knife according to claim 4, wherein the locating elements include spaced-apart holes in the holder at different distances from an edge of the holder.

* * * * *